United States Patent [19]

Hiers et al.

[11] 4,132,821

[45] Jan. 2, 1979

[54] TEXTILE FABRIC WITH LEATHER-LIKE APPEARANCE

[75] Inventors: John J. Hiers, Elkin; Stephen A. Wald, Winston-Salem, both of N.C.

[73] Assignee: Scott Chatham Company, Hamptonville, N.C.

[21] Appl. No.: 835,693

[22] Filed: Sep. 22, 1977

[51] Int. Cl.[2] ..... B32B 5/16

[52] U.S. Cl. ..... 428/151; 28/107; 428/218; 428/283; 428/286; 428/287; 428/288; 428/290; 428/334; 428/335; 428/336; 428/337; 428/904

[58] Field of Search ..... 428/151, 283, 286, 287, 428/288, 290, 212, 218, 334, 335, 336, 337, 904; 28/72.2 R, 75 R, 75 WT, 107, 108

[56] References Cited

U.S. PATENT DOCUMENTS

| | | | |
|---|---|---|---|
| 3,238,089 | 3/1966 | Griswold | 428/283 |
| 3,817,820 | 7/1974 | Smith | 428/904 |
| 3,906,131 | 9/1975 | Böe | 428/283 |
| 3,936,555 | 2/1976 | Smith | 428/904 |
| 3,940,532 | 2/1976 | Smith | 428/904 |
| 3,985,929 | 10/1976 | Bonin | 428/904 |

*Primary Examiner*—Marion E. McCamish
*Attorney, Agent, or Firm*—Murray and Whisenhunt

[57] ABSTRACT

There is provided a non-woven textile composite which simulates the strength, durability, appearance, temper, smooth surface, hand and feel of natural leather and a method of producing the same. The composite includes a non-woven needled textile fabric substrate having a coherent network of randomly entangled textile fibers with an as needled overall bulk density of at least 6 pounds/cubic foot and having a face surface and a back surface, and a geometric center therebetween. A shape-sustaining immobilized polymeric composition is differentially disposed in the substrate such that there is at least 25% more polymeric composition between the face surface and the geometric center than between the back surface and the geometric center. A moldable skin coat layer may be disposed on the face surface. The substrate and the immobilized polymeric composition are in a co-compacted state such that the thickness of the co-compacted substrate and immobilized polymeric composition are less than 0.75 the thickness of the substrate in the essentially uncompacted state.

38 Claims, 7 Drawing Figures

TEXTILE FABRIC WITH LEATHER-LIKE APPEARANCE

BACKGROUND OF THE INVENTION

Natural leather is the traditional material for producing quality leathergoods, such as footwear, waist belts, carpenter aprons, tool pouches, safety belts, small personal leathergoods, and the like. However, natural leather presents technical difficulties in manufacture, economic difficulties in marketing, and durability problems in use of these goods. Wide quality variations among hides, and defects within a hide cause technical difficulties in cutting hides in an economical manner, and the different sizes and shapes do not allow for automatic cutting of the hides. In addition to the difficulties of variations and defects, the rapidly escalating price of untanned hides and tanning labor and chemical costs have markedly increased the cost of leather in recent years. Thus, leather has become a very expensive component of finished goods. Moreover, leather's susceptibility to hydrolytic degredation has limited its application or utility in certain service environments.

For these and other reasons, considerable efforts have been made in the art to produce man-made leather substitutes. These substitute materials are commonly referred to, collectively, as artificial leathers, although these substitute materials may vary widely in their properties and some of the substitute materials have few properties in common with leather. In one respect, these differences between the properties of leather and the substitute materials are the results of efforts to provide properties which are not provided by leather and, in another respect, these differences are the results of the inability in the art to produce certain of the desirable properties of leather.

There have been two major approaches in the art to producing leather substitute materials. One major approach provides a permeable material while the other major approach provides an impermeable material. The permeable materials are based on a microporous film of up to 30 mils thick being disposed on a permeable substrate. The well-known CORFAM is an example thereof. The use of an impermeable film on a permeable or impermeable substrate has been more accepted commercially, and an example thereof is expanded PVC substitute materials. In the CORFAM-type material, a combination of a needled non-woven substrate and a woven element is used to provide the required strengths, since the decorative permeable film provides very little strength to that composite. On the other hand, the expanded PVC-type material relies to a significant degree on the relatively thick impermeable decorative film for strength and the textile substrate is a relatively light woven or non-woven substrate. The CORFAM-type material adsorbs moisture to a very slight extent, but being permeable is able to transmit that moisture even during use, while the expanded PVC-type material must adsorb the moisture during use and release the moisture during non-use from the undersurface thereof. The CORFAM-type material is subject to scuffing which is essentially non-repairable. On the other hand, the expanded PVC-type material has a relatively thick and somewhat spongy skin coat layer. This resists scuffing, but once scuffed, is effectively non-repairable.

Thus, the art has not produced a totally satisfactory substitute material and the difficulties associated with these materials inhibited wide acceptance thereof. Many efforts have been made in the art to mitigate these problems and a most significant advance in the art in this regard is disclosed in U.S. Pat. No. 3,817,820, issued on June 28, 1974 to Alexander M. Smith, II. That patent discloses that the axis of flexure of a needled textile fabric may be shifted toward the face surface by forming a web of loosely matted fibers (a conventional carded structure) where the web has a needle pick-up gradient from the back surface to the face surface, e.g., by using layers of fibers with different fiber deniers, and then needling the web sufficiently to produce an integral structure of coherent entangled fibers and to produce an overall bulk density of at least 6 pounds per cubic foot. It is taught that the high number of needle punches per square inch of the web with the needle pick-up gradient produces a bulk density at or near the back surface which is lower than the bulk density at or near the face surface and, hence, the axis of flexure of the needled structure is shifted toward the face surface, which in turn produces flexure properties in the substitute material which are similar to the corresponding leather flexure properties, while also providing a permeable material.

While the method of the Smith patent provides a leather substitute material which is superior to other substitute materials, it requires the use of multiple carding machines or multiple passes with a single machine to form and stratified web of fibers for needling. Carding machines are expensive capital equipment and require considerable factory floor space. Further, these machines must be properly supervised during the laying of the web for needling to insure that the required stratification of fibers is achieved. Thus, the use of the multiple carding machines or multiple passes thereby inherently increases the capital costs and production costs of the leather substitute material produced by that method. Therefore, it would be of decided advantage in the art if the functional advantages of the substitute of the Smith patent could be maintained while eliminating the necessity for multiple carding machines in making the needled substrate.

OBJECTS OF THE INVENTION

It is therefore an object of the invention to provide an artifical leather which has strength, durability, appearance, temper, smooth surface, hand and feel of natural leather without the necessity of providing a stratification or gradient of fibers with different needle pick-up characteristics. It is a further object of the invention to provide economical methods for producing artificial leathers of that nature, whereby relatively few process steps are required to convert raw materials into finished synthetic leather, and each process step is itself simple and controllable. Other objects will be apparent from the following disclosure and claims.

BRIEF DESCRIPTION OF THE INVENTION

Accordingly, there is provided a non-woven textile composite which simulates the appearance, strength, durability, temper, smooth surface, break, hand and feel of natural leather comprising a non-woven needled textile fabric substrate having a coherent network of randomly entangled textile fibers with an as needled overall bulk density of at least 6 lbs/cubic foot and having a face surface and a back surface and a geometric center therebetween. A shape-sustaining immobilized polymeric composition is differentially disposed in the substrate such that there is at least 25% more polymeric composition between the face surface and the geometric center than the back surface and the geometric center. A moldable skin coat layer may be disposed on and in the face surface. The substrate and the immobilized polymeric composition are in a co-compacted state such that the thicknesses of the co-compacted substrate and the immobilized polymeric composition are less than 0.75 the thicknesses thereof in the essentially uncompacted state. Conversely, the skin coat layer is in an essentially uncompacted state.

The composite is prepared by forming a web of loosely matted fibers and needling the web sufficiently to produce a textile fabric substrate having a coherent network of randomly entangled textile fibers with an as needled overall bulk density of at least 6 lbs/cubic foot and with a face surface and a back surface and a geometric center. A polymeric composition is differentially disposed in the substrate such that there is at least 25% more polymeric composition between the face surface and the geometric center than between the back surface and the geometric center. The composition is then immobilized and loosely adhered to the fibers of the substrate. Thereafter, the substrate and the immobilized polymeric composition are subjected to sufficient compaction so that the substrate is compacted to a thickness of less than 0.75 the thickness of the uncompacted substrate. The compacted substrate may be then coated with a moldable skin coat layer so that the skin coat layer is disposed on and in the face surface. The skin coat layer is then immobilized and adhered to the fibers and polymeric composition adjacent to and in the face surface.

DETAILED DESCRIPTION OF THE INVENTION

Figure 1:
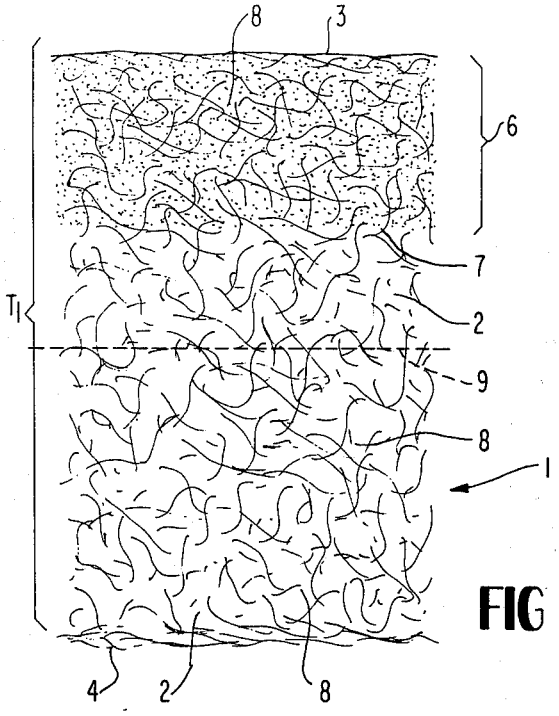
FIG. 1 is a highly idealized diagrammatic illustration of the needled textile substrate with the polymeric composition disposed therein. This figure also shows the optional filler in the needled substrate.

As noted above, the CORFAM-type substitute material uses woven fabric to provide strength to the nonwoven bulk providing substrate. That composite, however, is not yieldable in the manner of leather and results in serious disadvantages in both the manufacture and use of many "leather" goods, particularly shoe uppers. The expanded PVC-type substitute material, also uses a woven fabric but in addition has an impermeable skin coating. Both of these substitute materials have suffered low tensile and tear strengths and shoemaking is difficult, as compared with natural leather and many "leather" goods constructed therewith, e.g., shoe uppers, are not durable in the manner of leather.

The product of the above-noted Smith patent has high strength and good shoemaking properties and may be permeable but the necessity for multiple carding to achieve a needle pick-up gradient complicates the commercial manufacture of that substitute material. The explanation in the Smith patent for the necessity of a multiple carding is to ultimately achieve a shifted axis of flexure of the needled substrate. The shifted axis of flexure is said to mimick the corresponding shifted axis of flexure of natural leather and thus provide functional properties to the substitute material which are similar to the corresponding functional properties of natural leather.

A major feature of the present invention is the discovery that when a needled substrate of essentially the same fibers has therein a differential disposition of a polymeric composition, functional properties similar to corresponding functional properties of the product of the Smith patent (and natural leather) are obtained, without the necessity of a needle pick-up gradient. As can be appreciated, with the present invention the necessity for multiple carding is avoided and the process for producing the leather substitute material is simplified and rendered less expensive.

Aside from the use of a needle pick-up gradient in the web of fibers to be needled, the needling technique disclosed in the Smith patent is equally applicable to the present invention and for the sake of conciseness, that needling technique and suitable apparatus will not be described in detail herein. For those techniques and apparatus, see the Smith patent, the entire disclosure of which is incorporated herein by reference and relied upon for those details. It is emphasized that in the present invention, the fibers of the mat of fiber is essentially uniform throughout the cross-section thereof, but this does not mean that the uniform cross-section cannot be a uniform mixture of fibers, i.e., different sizes, shapes and deniers.

Turning now to a detailed description of the invention, a web of loosely matted fibers are formed by carding or other similar textile process, e.g., air laying, mechanical laying, etc., to produce a web suitable for needling. The fibers which are formed into the web will be essentially similar, i.e., there will be no substantial needle pick-up gradient. As will be appreciated, commercially available fibers may have some variation in fiber denier, fiber length or other fiber geometry which could induce small amounts of needle pick-up gradient within the supply of fiber. This needle pick-up gradient, however, will not have a material effect upon the needled web, at least to the extent required by the Smith patent, and for purposes of the present specification and claims, the term "no substantial needle pick-up gradient" will refer to these commercial variations which do not materially effect the needled web.

It should also be appreciated that if desired a layer of fibers of different needle pick-up characteristic may be layed on the web to achieve a decorative or functional effect at the surface of the web. For example, if fine fibers are needled into one surface of the web that surface has increased smoothness which is desirable for certain types of leather. The amount of such fine fibers needled into the surface of the web will be so small, however, that there will be no substantial shifting of the axis of flexure due to needling this small amount of fine fibers.

Since the present web is of substantially the same fibers, as opposed to the fiber gradient to produce the shifted axis of flexure in the Smith patent, the present invention departs from the fiber arrangement of the Smith patent in that relatively fine fibers are used. Thus, the fiber denier will normally be between 1 and 5 denier, preferably between 1½ and 3 denier. The fiber length will be between 1 inch and 5 inches, more usually between 1½ inches and 4 inches (all uncrimped lengths). These finer fibers provide an improved needled substrate and are also beneficial in accurately disposing the polymeric composition so that a differential disposition thereof is achieved. Further, the finer the denier, the softer the substrate. Hence, the all fine denier substrate is significantly softer than the gradient denier substrate of the Smith patent which uses higher denier fibers.

After the web has been formed it is then passed to a needling machine where the web is sufficiently needled to produce a textile fabric substrate having a coherent network of randomly entangled textile fibers and having an overall bulk density of at least 6 lbs/cubic foot and up to 12 lbs/cubic foot.

The needled web according to the present invention is generally thicker for any given web weight than the needled web of the Smith patent. Thus, typically, after the needling operation has been completed, the present web will have a thickness in the range of 75–250 mils, more usually between 150 and 200 mils. In any event, the thickness at this stage should be at least 125% of the intended final compacted thickness, especially between 150 and 300%.

After the needling operation, the substrate is subjected to impregnation with polymeric composition and, optionally, a filler. The substrate is not compacted at this stage of the process, e.g., by calendering and the like. Neither is it subjected to any relaxation, either thermal or mechanical, as is taught to be a preferred procedure in the Smith patent. Applying the polymeric composition at this stage, as opposed to the stages after compaction, according to the prior art, has provided several important and unexpected results. First of all, the impregnants can be far more accurately placed in a relative portion of a thick web than the accuracy of placing those impregnants in the same relative portion of a compacted thin web. For example, if a compacted web has a thickness of 70 mils, then to place an impregnant in the upper 25% (within 0.25 of the face surface), the impregnant must be accurately placed within only an 18 mils thickness range. However, if the uncompacted substrate, according to the present invention, has a thickness of 160 mils, then a total of 40 mils may be used for containing the impregnant and still achieve the same relative accuracy. Thereafter, the web can be compacted by heat and pressure, or the like, to the same 70 mils, of the prior art thicknesses, but the impregnant will have been substantially more accurately placed therein than was possible by the prior art techniques.

By this method the polymeric composition may be accurately impregnated into the needle substrate and a differential disposition is achieved so that the flexure/modulus strength properties of the impregnated substrate mimick the flexure/modulus properties of natural leather and the leather substitute of the Smith patent. Further, in this regard, the compacting of the substrate after being impregnated with the polymeric composition apparently provides a favorable fiber geometry in relationship to the differentially disposed polymeric composition such that the described flexure/modulus properties are accentuated and more nearly equal those of natural leather. Here again, the theoretical explanation is not understood but, while not being bound by theory, it appears that the fibers being compacted in the presence of the differentially disposed polymeric composition achieve an inter-relationship between the fibers and composition such that the impregnated substrate mimicks the flexure/modulus properties of the Smith product and natural leather.

It is therefore critical to the invention that the polymeric composition be applied to the essentially uncompacted web and that the necessary compaction be carried out after the polymeric composition has been differentially disposed therein. It is also of substantial advantage that the decorative skin coat (placed on the face surface of the substrate) and support coats therefore not be coated onto the substrate until after this compaction has occurred. Otherwise, the decorative skin coat may show a rough surface characteristic which reflects the underlying fibrous substrate and this appearance is undesirable in certain simulated leathers. Of course, once the skin coat is placed on the face surface, embossing of the decorative skin coat to induce a desired graining will also include some further compaction of the substrate. This further compaction, however, should be distinguished from that compaction used to cause the required inter-relationship of the compacted substrate and differentially disposed polymeric composition.

The differentially disposed polymeric composition also performs a further function. With the disposition being closer to the face surface than to the back surface, as described above, absorption of any decorative skin coating will be hindered by virtue of the barrier created by the differentially disposed polymeric composition. In a sense, the polymeric composition, therefore, breaks the flow of the decorative skin coat material applied to the face surface and, hence, functions as a "sealer/primer." By thus ensuring that the decorative skin coating materials are essentially maintained near the face surface, the required decorative effects can be achieved without the unwarranted infusion of the decorative skin coat materials substantially into the internal structure of the needled substrate. This avoids undesired hand and feel, often associated with prior art materials and sometimes referred to as a "boardy" hand and feel. To maximize this effect, it is preferred that at least 30% more and more preferably at least 40% or even 50% more polymeric composition be disposed between the face surface and the geometric center than between the back surface and the geometric center. The best mode is where this amount is about 100%.

The polymeric composition must be capable of being immobilized or settable, i.e., convertible from a liquid to a solid form. As explained above, the polymeric composition must be differentially disposed in the substrate and to achieve this result a flowable polymeric composition must be impregnated into the substrate. However, after reaching the desired differential disposition, the polymeric composition must be rendered immobile so that it will remain at this desired disposition. The polymeric composition may be immobilized or set by any of the conventional mechanisms, e.g., solvent removal, drying a water solution or emulsion, cross-linking, cooling a melt, reactivity with other components, etc. Thus, suitably, the polymeric composition may contain a thermosetting or thermoplastic natural or synthetic polymer. A wide variety of such polymers are known to the art and include natural and synthetic rubbers, acrylics, acrylo-nitriles, SBA latex, acrylates, polyurethane, polyvinyl chloride, polyolefins, etc. See U.S. Pat. Nos. 3,000,757; 3,067,482; 3,100,721; 3,190,766; 3,208,875; 3,284,274 and 3,483,015 for suitable polymers for the polymeric compositions.

It should be understood, however, that since after the polymeric composition is placed on the substrate, the substrate is compacted to the more conventional thicknesses of artificial leather, the polymeric composition must be deformable. For example, by placing the substrate and polymeric composition under heat and/or pressure, permanent compaction may be achieved. Suitably, therefore, the polymeric composition will be a thermoplastic material, or at least a thermosetting material which has thermodeformable properties.

Additionally, the polymeric composition must be relatively inert to the environments usually encountered by leather goods. For example, the polymeric composition must not be substantially deteriorated by animal prespiration; it must be able to sustain repeating wettings with water, and subsequent dryings, it must be non-toxic and stable at normally encountered outside temperatures.

The polymeric composition in its immobilized state, i.e., set, cured, cross-linked, etc., must be yieldable. For purposes of the present specification and claims, and in connection with the polymeric composition, the term "yieldable" means that the composition when disposed in the needled substrate as described above can experience a 180° fold of a ½ inch wide 4 inches long strip of impregnated and compacted substrate (without skin coat or other decorative coats) without sustaining palpably dectable destruction of the flexure/modulus properties of the polymeric composition and wherein the elasticity of the composition is not sufficient to automatically return the folded strip to its original position. In other words, a 4 inch strip of impregnated substrate can be folded end to end without substantial deterioration of the properties of the strip and once folded the strip will tend to remain in a somewhat folded configuration and will not spring back to the flat position. In this connection, it is not necessary that the ends of the folded strip remain together, but on the other hand they should not return toward the original flat position. This ensures the correct temper, hand, drape and feel of leather.

As noted above, many polymers known to the art will achieve the properties required for the polymeric composition. However, it has been discovered that a particular class of polymers provides especially good results. This class of polymers is known to the art as acrylonitrile co-polymers. It has been found that these polymers advantageously co-function with the fiber after compaction, as explained above, to provide the functional properties of leather, e.g., the flexure/modulus properties. Also, these polymers are especially useful for poviding a very desired property of the polymeric composition. Thus, when compaction of the polymeric composition is achieved by calendering, the surface advantageously deforms to provide a smooth surface for skin coating. The acrylo-nitrile polymers are especially useful in this regard. Thus, the acrylo-nitrile latex polymers are the preferred embodiment of the invention for the polymeric composition.

The skin coat layer must also be moldable, since the skin coat layer is normally embossed to provide the desired surface texture. Here again, it is preferred that the skin coat layer be thermo- and pressure- deformable so that presses, calenders, and the like may be used for embossing the desired grain onto the skin coat layer.

Similarly, thermoplastic materials are preferred or at least thermodeformable thermosetting materials. Especially useful in this regard are the skin coats described in the Smith patent, particularly the acrylics, acrylates, polyurethanes, polyvinylchloride and polypropylene.

The skin coat material must, in the liquid state, be capable of forming films, e.g., from 2–20 mils in thickness. The liquid state of the skin coat preferably will have a relatively high solids contents. It is preferred that the solids content of the skin coat be at least 50% and more preferably 75%. Of course, 100% solids skin coat is the preferred embodiment.

In both cases of deforming the substrate/polymeric composition, and the skin coat, conventional deforming processes may be used, suitable examples of which are disclosed in some detail in the aforementioned Smith patent. Generally speaking, however, presses, calanders and the like are suitable. In any event, the usual thickness after compaction is between 20 and 200 mils, and more typically between 30 and 125 mils.

The particular composition of the fibers is not critical, and various fibers or combinations may be used. These may include natural fibers of plant or animal origin such as cotton, collagen and wool. However, for the same reasons stated above, the fibers are preferably heat and pressure deformable, so that the compacting step will provide a permanent deformation of both the fibers and polymeric composition. Accordingly, the synthetic fibers such as nylon, acrylics, olefins, e.g., polyethylene, polypropylene, polyvinyl chloride, polyvinyl acetate/polyvinyl alcohol, polyvinyl chloride/polyvinyl vinylidene and polyester are preferred. The best mode of the invention is nylon and/or polyester fibers, since these fibers provide excellent workability in the process and have inherent chemical properties which resist degradation due to perspiration and the like.

The fibers may also be shrinkable or stabilized fibers, oriented or unoriented fibers, and dyed or undyed fibers. Sufficient amounts of fibers must be carded into the web of fibers such that the weight of the web (either before or after needling) is from 4 to 40 ounces per square yard and more preferably from 6 to 25 ounces per square yard.

The amount of polymeric composition placed in the needle substrate will be at least 10 and up to 140 grams per square foot. More preferably, this amount will be between 15 and 20 grams per square foot.

The amount of the skin coat is not critical, but the thickness of the skin coat must be sufficient to allow at least some embossing for decorative purposes. Thus, the finished skin coat should have a thickness of 2 mils and up to about 20 mils, preferably between about 3 and 10 mils. Five mils is a very suitable thickness of the skin coat.

An inert filler is advantageously placed in the substrate to improve the hand and feel of the resulting artificial leather, e.g., the "dead" hand and feel of leather. The filler may be either non-uniformly or uniformly distributed throughout the substrate but it will usually be essentially uniformly distributed by impregnating the filler prior to impregnating the polymeric composition. The fillers may be any of the fillers disclosed in the aforementioned Smith patent, but it is preferred that inorganic fillers be used. Thus, clays, alumina, bentonite, kaolin, asbestos, diatomacious earth, silica flour, mica, magnesium silicates and various oxides, or the like, are preferred, although the organic fillers, and particularly the polymers, disclosed in the Smith patent may be used. Similarly to the disclosure of the Smith patent add ons of the filler as little as 5% and up to 200% by weight of the fibers of the substrate may be used, but add ons between 10% and 150%, especially 20% to 100% are preferred.

Of course, when inorganic fillers, such as alumina, clays and the like, are used as fillers, they must be contained in the needle substrate by an appropriate matrix. It will also be appreciated that the matrix must not interfer with the desirable properties of the composite, e.g., the matrix must not render the composite stiff or boardy or otherwise degrade the flexure/modulus characteristics. This is particularly true since the filler with matrix may compose an appreciable part of the composite, within the ranges of filler noted above. In view thereof, it is preferred that the matrix be a relatively soft polymer which has some elastomeric/adhesive effect toward the fibers although it is not intended that the matrix tightly bind the fibers. Thus, plasticized polyvinyl chloride, natural rubber, butadiene rubbers, polychloroprene rubbers, polyurethane rubbers, silicone rubbers, chlorosulfonated polyethylene, fluorosilicone rubbers, poly(alkyleneoxide) polymers or any of the conventional leather fillers. However, it is preferred to use the softer polymers such as the acrylate polymers, since these polymers give an improved "deadness" to the finished product and do not interfer with any of the other desired properties. In addition, these softer polymers do not stiffen at colder temperatures nor become tacky at higher temperatures, especially with a solid lubricant therein, such as zinc stearate.

The particular filler and filler matrix are not critical so long as the filler does not interfer with the desired properties of the artificial leather and so long as the filler is chemically compatible with the polymeric composition, i.e., does not adversely effect the polymeric composition. As can be appreciated, the polymeric composition must stay relatively intact and should not be plasticized or otherwise degraded in its properties by the filler or filler matrix.

It should also be appreciated that the filler, particulary the inorganic fillers, may be included in the polymeric composition, per se, and that that polymeric composition may function both for the purposes described above and as the matrix for the inorganic filler.

It will also be appreciated that there should be compatibility between the skin coat and the filler (optionally associated with a matrix) and the polymeric composition. If the skin coat is not compatible with either the filler or the polymeric composition, one of the three may degrade with age. For example, a plasticizer in one may bleed into the other and cause a decrease of the desired properties. Alternately, for example, the skin coat may not adhere to either the polymeric composition or the filler composition.

While the foregoing is not a problem with the usual filler and polymeric compositions, to ensure against such problems, a base coat may be placed between the substrate and the skin coat. This is a conventional technique in the leather art and will not be described herein in detail for sake of conciseness. However, the conventional acrylics, acrylates, urethanes, natural and synthetic latices may be used in this regard.

The other optional coats for decorative purposes, normally associated with artificial leathers and as particularly described in the Smith patent, may be used. Thus, a toning coat may be associated with the base coat, or may be placed between the polymeric composition and skin coat. The toning coat or the base coat may have a dye, pigment, color or the like for providing appropriate color to the artificial leather. These coatings are well known in the art and need not be described in detail herein. Likewise, the skin coat may have a polish coat thereover, such as the conventional nitrocellulose lacquer coats, and again these coatings are well known in the art.

The final thickness of the artificial leather may vary considerably. Generally speaking, however, the thickness will be from 25 to 210 mils, and more usually from 30 to 125 mils.

As explained above, the substrate will have been compacted in producing the final artificial leather and along with added fillers and the like, the density of the substrate in the final form will have substantially increased from the needled density. Densities of the substrate of at least 8 lbs per cubic foot may be achieved, and even densities of at least 12 lbs per cubic foot. When the substrate filled it may have densities between 12 and 45 lbs per cubic foot. Higher densities may also be achieved by the kind of needling performed. Thus, with higher needling, such as 8,000 to 25,000 needle punches per square inch and especially 12,000 to 22,000, greater densities will be achieved. Preferably the needling, especially this higher needling, is performed by the FIBERWOVEN technique of the Smith patent, since this accentuates the coherent network of entangled fibers and arranges some of the fibers in oriented rows of fiber chain entanglement, with the rows extending lengthwise of the structure, as explained in some detail in the Smith patent.

Turning now to the details of the product and process, as illustrated by the drawings, FIG. 1 is a highly idealized illustration of the substrate with the polymeric composition disposed thereon. The substrate generally 1 is composed of a network of entangled fibers 2 and having a face surface 3 and a back surface 4. The differential disposition of the polymeric composition 6 is indicated by the darkened area. As illustrated, most of the composition is contained in about 0.25 the distance from the face surface to the back surface as indicated at 7. It should be understood that the polymeric composition is a permeable layer. Filler particles are generally indicated as 8, and the thickness of the fabric is indicated at $T_1$. The geometric center, i.e., the ½ distance from the face surface to the back surface, is shown by dashed line 9.

Figure 2:
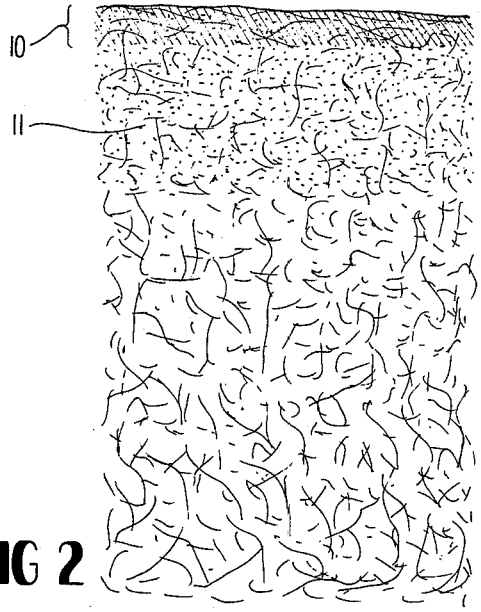
FIG. 2 is a similar diagrammatic illustration which shows the optional base coat applied to the substrate and interlocked to the differentially disposed polymeric composition.

FIG. 2 is a like diagrammatic illustration showing the optional base coat applied to the substrate and is shown as the heavier shaded area 10 which totally intermeshes with the polymeric composition indicated by the less heavier shaded area 11, although it should be understood that the polymeric composition and the base coat are not distinct separable layers but are intermingled, with the base coat being predominantly further toward the face surface than the polymeric composition.

Figure 3:
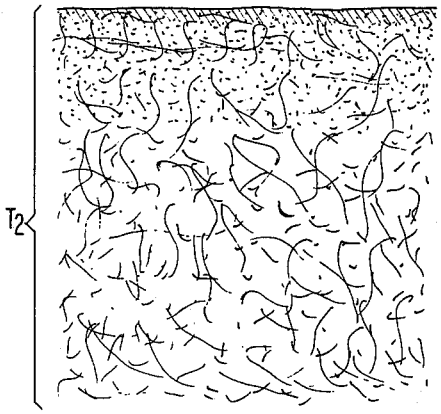
FIG 3 shows the substrate of FIG. 2 after it has been subjected to heat and pressure for compaction thereof.

FIG. 3 shows the product of FIG. 2 after the product has been subjected to heat and pressure for compaction thereof. The thickness is now indicated as $T_2$. Note that the thickness has been reduced by approximately ⅓.

Figure 4:
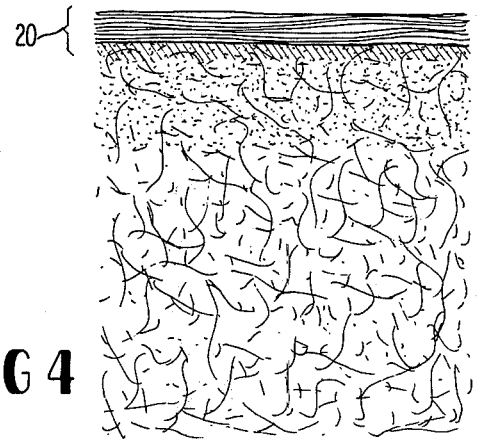
FIG. 4 shows the compacted substrate of FIG. 3 on which has been placed a decorative skin coat layer.

FIG. 4 shows the compacted product of FIG. 3 on which has been placed a decorative skin coat layer 20. It should be noted that the skin coat may be an impermeable layer, as opposed to the permeable polymeric composition layer and base coat layer. Also note that the skin coat layer may intermingle with the base coat layer, when used, and with the polymeric composition layer, as well as adjacent fibers in connection with both of those layers. Thus, the skin coat layer may be both chemically and mechanically locked to the substrate, but is yet moveably adhered thereto.

Figure 5:
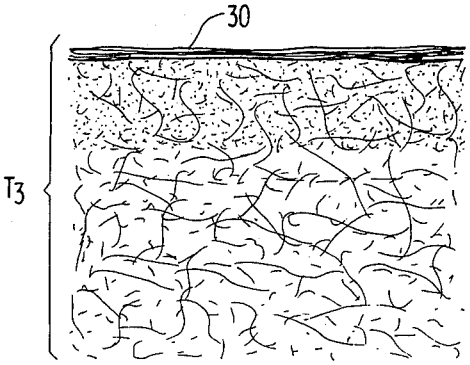
FIG. 5 shows the product of FIG. 4 which is embossed to provide the surface texture of leather.

FIG. 5 shows the product of FIG. 4 which has been embossed to provide the surface texture of leather. Note the hair follicle-like indentations 30 and also note that the thickness $T_3$ has again been reduced in this embossing step. The thickness is now appoximately ½ of the thickness of the substrate illustrated in FIG. 1. It will be appreciated that the embossing step, therefore, further reduces the thickness of the substrate. The embossed artificial leather may have decorative finish coats thereover, such as the polish coat and the like.

Figure 6:
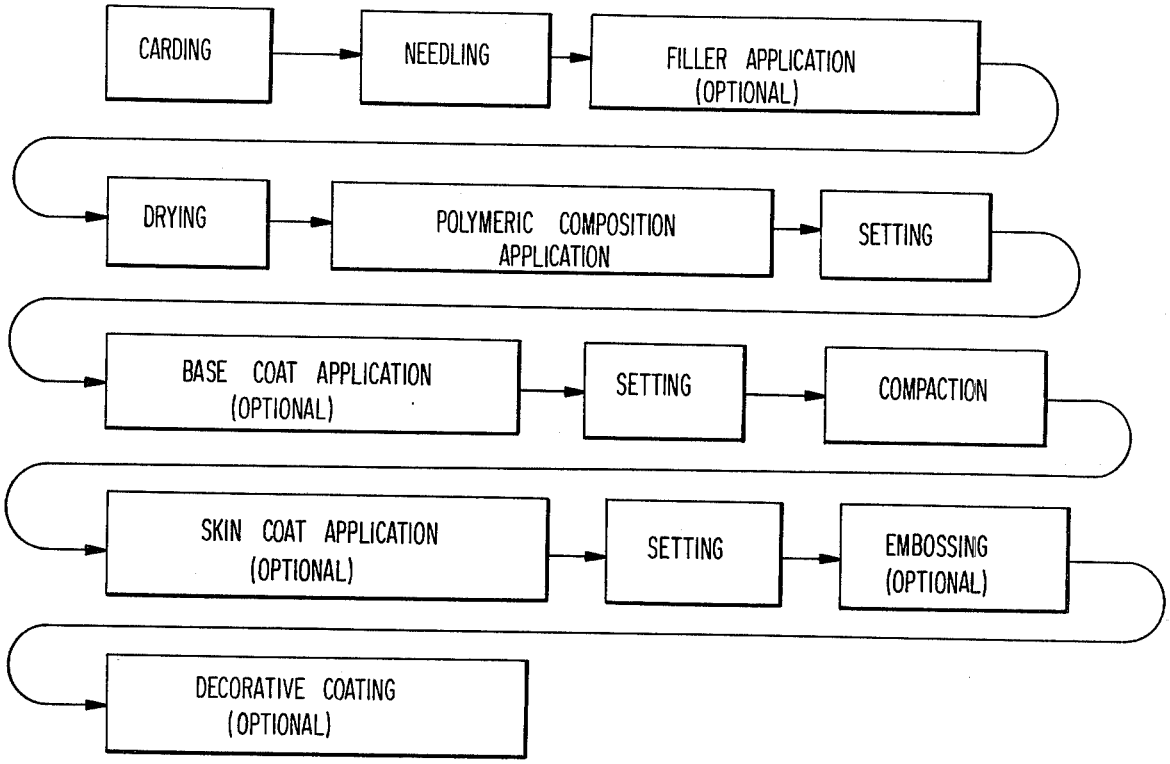
FIG. 6 is a diagrammatic illustration of the overall process of the invention.

The overall process of the invention is diagrammatically illustrated in FIG. 6. As can be seen, the fibers are carded in a conventional manner to provide the web of fibers.

Thereafter, needling takes place in the same manner described in the Smith patent to accomplish the overall bulk densities described above, at least 6 pounds per cubic foot. As stated, needling is accomplished without a needle pick-up gradient, i.e., the mat is composed of essentially uniform textile fibers (no essential difference in length or denier). Needling may be both sides, as in the FIBERWOVEN loom and again, with the preferred fiber chain entanglement.

Thereafter, the optional filler may be placed in the substrate by conventional pad and nip to the add ons described above. Since the filler will normally be in a conventional matrix, the substrate will then be dried to set the matrix in the substrate.

The polymeric composition is then applied to the substrate so that the disposition and amount thereof is as disclosed above. The method of applying the polymeric composition can be as desired, but preferably the disposition is by applying the composition to the face surface. This is the best mode of the invention. A suitable method for applying the polymeric composition is described in detail hereinafter in connection with FIG. 7.

The polymeric composition is then set, e.g., by drying, although other mechanisms may be used as described above. Setting conditions will vary with the particular composition, but when heat is used, it is only necessary that the drying temperatures do not exceed the stabilization temperatures of the particular fibers used in the substrate, e.g., from ambient to 500° F. This setting provides a shape-sustaining polymeric composition, i.e., is no longer flowable.

Thereafter, the optional base coat is applied. It is preferred that the base coat be applied in a smiliar manner to the polymeric composition, in order to insure greater disposition toward the face surface. However, since the polymeric composition will already be in the substrate, the base coat may be applied by very conventional techniques, such as doctor blades and rods, kiss rollers, and the like, so long as the application is from the face surface. It will be appreciated that the already disposed polymeric composition will limit the migration of the base coat into the substrate.

Again, the base coat is set, usually by drying, and again the conditions are not critical, within the limitation noted above.

Therefore, the polymeric composition and optional base coat have been very accurately placed in the substrate, as indicated by FIGS. 1–5 above. Now, the substrate can be compacted to the desired thickness while maintaining that much improved accuracy of disposition. Compaction may be in manner desired, but heated rolls, presses and the like are quite suitable. Here again, the temperature is not critical, so long as adequate permanent compaction is achieved, and the stabilization temperatures of the particular fibers are not exceeded. Quite suitably compaction is accomplished by a conventional calendering operation at temperatures between 225° and 500° F., at pressures between 50 and 1,000 lbs per linear inch.

The skin coat is then applied to the compacted substrate and the skin coat may be applied by any of the conventional methods, e.g., doctor blades, kiss rollers, coating tables, spraying, etc., since the substrate has the differentially disposed composition and compaction, and substantial penetration of the skin coat will not occur.

Again, the skin coat is set, e.g., dried and/or cross-linked and the like. Conditions for setting are again not critical, so long as the stabilization temperatures of the fibers is not exceeded.

After the skin coat has been set, the artificial leather so produced is embossed to give a texture of natural leather. The embossing may suitably be by heated embossing rolls or plates. Embossing temperatures will be according to the particular skin coat material, but temperatures between 225 and 500° F. and pressures between 5 and 500 lbs per square inch are quite suitable.

Finally, any desired decorative finish coats may be applied over the embossed coat, such as a polish coat, final color coat, etc. The setting of these coats will be according to the particular coat used, all of which is well known in the art and will not be repeated herein for sake of conciseness.

Figure 7:
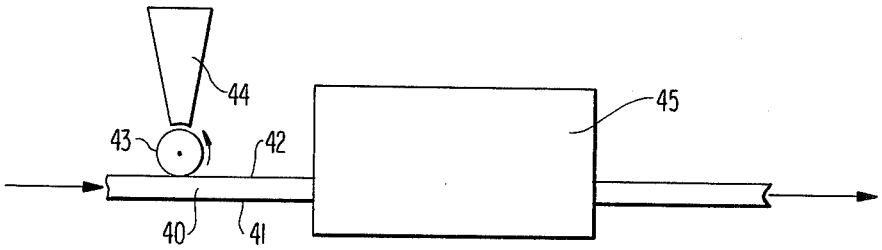
FIG. 7 is a diagrammatic illustration of a convenient means for differentially disposing the polymeric composition in the needled substrate.

FIG. 7 diagrammatically illustrates convenient means for differentially disposing the polymeric composition and skin coat layer in and on the needle substrate. In FIG. 7 the needled substrate 40 with a back surface 41 and a face surface 42 is coated by a gravure roll 43, fed by a hopper 44. The coated substrate is passed to a convection oven 45 where the coating is set. Coating with a gravure roll causes a differential disposition toward the face surface of substrate 40.

The invention will be illustrated by the following Example, but it should be understood that the invention is not limited thereto and extends to the breadth of the foregoing disclosure and the annexed claims. In the specification and examples, unless otherwise noted, all parts, ratios and percentages are by weight.

EXAMPLE 1

A uniform web of loosely matted polyester fibers (1½ denier and 1½ inches crimp length, 18 oz/yd$^2$) was carded onto a moving belt. This web is slightly compacted under a compacting roll to aid in feeding to needle looms. The web is needled in a series of FIBERWOVEN looms with 1-16-4C or -3C needles (1-barb-16mil triangular blade -4 or -3 mil barb) until the density of about 6 lbs per cubic foot was achieved.

*Thickness of web for density purposes determined by ASTM D-461.

The needled web was impregnated with a filler having the following composition:

| Impregnant Formula | |
|---|---|
| Ingredients | Pounds |
| A. Water | 308.71 |
| Tamol SN (Dispersing Agent) | 1.78 |

-continued

| Ingredients | | Pounds |
|---|---|---|
| | Impregnant Formula | |
| | Triton X-155 (Wetting Agent) | 0.20 |
| | Alumina Trihydrate GHA 732* (Clay Filler) | 133.64 |
| B. | Hycar 2600 × 189 (Acrylic Resin) | 418.75 |
| | Dow Corning H-10 (Silicone Antifoam) | 0.45 |
| | Water | 0.89 |
| C. | Ammonia 26° (For pH adjustment) | 7.13 |
| | Water | 9.91 |
| D. | Water | 64.15 |
| | Zinc Stearate (Lubricant and Detackifier) | 24.95 |
| E. | Lumatex Yellow 1815 (Pigments) | 20.31 |
| | 20-N Light Iron Oxide (Pigments) | 9.80 |
| | Lumatex Black (Pigments) | 0.34 |
| | | 1,000.00 |

*Great Lakes Foundry Sand Co. (Mineral Products Division)

The ingredients were simply mixed. Impregnation of the filler was by pad and nip and the impregnated substrate was dried on conventional cans at temperatures between 250° and 300° F.

The substrate has a thickness which varies between 150 and 170 mils and a polymeric composition coating was placed on the face surface of the substrate with a heavy line gravure printer. The polymeric composition was an acrylo-nitrile latex (Hycar latex 1571). After drying, the polymeric composition is set and about 100% more of the polymeric composition is between the face surface and the geometric center than between the back surface and the geometric center, as shown by weighing microtome ½ cross-sections of the substrate, i.e., weighing and comparing filled substrate and substrate with the filler and polymeric composition therein. On a similarly prepared sample, this disposition of polymeric composition is confirmed by contrastingly pigmenting the polymeric composition.

The amount of filler in the substrate was about 30 grams per square foot and the amount of polymeric composition was about 15 to 20 grams per square foot.

The substrate was then calendered at temperatures between 225 and 325° F. and under pressures of about 400 lbs per linear inch. The thickness of the calendered substrate was between about 60 and 70 mils.

A skin coat was applied to the calendered substrate by a doctor rod from a 100% solid stock to provide 5 mils (dry) skin coating. The skin coat was cross-linkable polyurethane. After drying at about 275° F. in a conventional oven, the skin coat was embossed with a hot press at temperatures of about 345° F. for 15 seconds, using a Sheridan batch press with a pressure of about 500 lbs per square inch. The top platen was grained to resemble leather and the bottom platen was flat. This embossing step further reduced the thickness of the substrate such that the average thickness was about 65 mils, including the coating.

A top polish coat was sprayed on the embossed fabric with an atomizing spray nozzle and dried at a temperature of about 200° F. The polish coat was a conventional nitrocellulose lacquer (50%) and methylethylketone and diisobutylketone solvent (45% total) with 5% carbon black therein.

The resulting product had the appearance, feel and texture of natural leather. It also had a "break" rating of between 2 and 3 on a SATRA Break Pipeyness Rating Scale. The SATRA rub test (both wet and dry) showed no damage. The SATRA Vamp-flex test showed no cracking at 1 million cycles.

What is claimed is:

1. A non-woven textile composite which stimulates the strength, durability, appearance, temper, smooth surface, break, hand and feel of natural leather comprising:

(a) a non-woven needled textile fabric substrate having a coherent network of randomly entangled essentially uniform textile fibers with substantially no needle pick-up gradient and with an as needled overall bulk density of at least 6 pounds/cubic foot and having a face surface and a back surface, and a geometric center there-between;

(b) a shape-sustaining immobilized polymeric composition differentially disposed in the substrate such that there is at least 25% more polymeric composition between the face surface and the geometric center than between the back surface and the geometric center;

(c) and wherein the substrate and immobilized polymeric composition are in a co-compacted state such that the thickness of the co-compacted substrate and immobilized polymeric composition are less than 0.75 the thickness thereof in the essentially uncompacted state.

2. The composite of claim 1 wherein the substrate has essentially uniformly distributed therethrough a filler which increases the leather-like hand and feel of the substrate.

3. The composite of claim 2 wherein the filler in the substrate has a weight between 5% and 200% of the weight of the fibers in the substrate.

4. The composite of claim 3 wherein the overall bulk density of the filled substrate is between 12 and 45 pounds per cubic foot.

5. The composite of claim 1 wherein a moldable skin coat layer is disposed on the said compacted substrate.

6. The composite of claim 5 wherein the skin coat layer is contained in and on the substrate in amounts between 2 and 20 mils.

7. The composite of claim 5 wherein the skin coat is embossed to a leather-like appearance.

8. The composite of claim 7 wherein there is a base coat layer under the skin coat layer and the base coat has a pigment, dye or color therein or has a pigmented, dyed or colored toning coat associated therewith.

9. The composite of claim 1 wherein the skin coat layer has a polish coat thereover.

10. The composite of claim 1 wherein the substrate and polymeric composition contain heat and pressure deformable materials, and the substrate and polymeric composition are heat and pressure deformed.

11. The composite of claim 1 having a thickness of from 25 to 210 mils.

12. The composite of claim 11 wherein the thickness is from 30 to 125 mils.

13. The composition of claim 1 wherein the polymeric composition is contained in the substrate in amounts between 10 and 140 grams/ft$^2$.

14. The composite of claim 1 wherein the coherent network of entangled fibers includes some of the fibers being oriented into rows of fiber chain entanglement, the rows extending lengthwise of the structure.

15. The composite of claim 1, wherein the overall bulk density of the substrate is at least 8 pounds per cubic foot.

16. The composite of claim 1 wherein the overall bulk density of the substrate is at least 12 pounds per cubic foot.

17. The composite of claim 1 having from 8,000 to 25,000 needle punches per square inch.

18. The composition of claim 1 wherein there is at least 30% more polymeric composition between the face surface and the geometric center than between the back surface and the geometric center.

19. The composition of claim 1 wherein there is at least 40% more polymeric composition between the face surface and the geometric center than between the back surface and the geometric center.

20. The composition of claim 1 wherein there is at least 50% more polymeric composition between the face surface and the geometric center than between the back surface and the geometric center.

21. The composition of claim 1 wherein the said thickness of the co-compacted substrate and polymeric composition is less than 0.65.

22. A method for producing a non-woven textile composite which simulates the strength, durability, appearance, temper, smooth surface, break, hand and feel of natural leather comprising:

(a) forming a web of loosely matted essentially uniform textile fibers with substantially no needle pick-up gradient;

(b) needling the web sufficiently to produce a textile fabric substrate having a coherent network of randomly entangled fibers having an as needled overall bulk density of at least 6 pounds/cubic foot with a face surface and a back surface and a geometric center therebetween;

(c) differentially disposing in the so-produced and essentially uncompacted substrate a polymeric composition such that there is at least 25% more polymeric composition between the face surface and the geometric center than between the back surface and the geometric center;

(d) immobilizing the polymeric composition and loosely adhering the composition to the fibers of the substrate;

(e) subjecting the substrate and immobilized polymeric composition to sufficient co-compaction such that the co-compacted substrate and immobilized polymeric composition are compacted to a thickness less than 0.75 the thickness thereof in the essentially uncompacted state.

23. The method of claim 22 wherein a filler is essentially uniformly impregnated throughout the substrate prior to disposing the polymeric composition in the substrate whereby the leather-like hand and feel of the substrate is increased.

24. The method of claim 22 wherein a skin coat is disposed on the face surface after the said compaction.

25. The method of claim 24 wherein the skin coat is embossed to a texture which is leather-like.

26. The method of claim 24 wherein a polish coat layer is applied over the sin coat layer.

27. The method of claim 24 wherein the substrate and polymeric composition are heat and pressure deformable, and the substrate and polymeric composition are heated and pressure is applied thereto to deform and compact the substrate and polymeric composition prior to applying the skin coat layer.

28. The method of claim 24 wherein the thickness of the skin coat layer is between 2 and 20 mils.

29. The method of claim 24 wherein the skin coat layer is contained on the substrate in an amount of between 2 and 10 mils.

30. The method of claim 23 wherein the filler is impregnated in an amount of between 5% and 200% of the weight of the fibers in the substrate to provide a bulk density of the structure of between 12 and 45 pounds per cubic foot.

31. The method of claim 22 wherein a base coat layer is applied under the skin coat layer and the base coat layer has a pigment, dye or color therein or wherein a pigmented, dyed or colored toning coat is associated therewith.

32. The method of claim 22 wherein the thickness of the deformed and compacted substrate is from 20 to 200 mils.

33. The method of claim 32 wherein the thickness is from 30 to 125 mils.

34. The method of claim 22 wherein the polymeric composition is applied to the substrate at a rate between 10 and 140 grams/ft$^2$.

35. The method of claim 22 wherein there is at least 30% more polymeric composition between the face surface and the geometric center than between the back surface and the geometric center.

36. The method of claim 22 wherein there is at least 40% more polymeric composition between the face surface and the geometric center than between the back surface and the geometric center.

37. The method of claim 22 wherein there is at least 50% more polymeric composition between the face surface and the geometric center than between the back surface and the geometric center.

38. The method of claim 22 wherein the said thickness of the co-compacted substrate and polymeric composition is less than 0.65.

* * * * *